United States Patent [19]

Spinelli

[11] Patent Number: 4,942,699

[45] Date of Patent: Jul. 24, 1990

[54] VENTING OF ROOFS

[75] Inventor: Larry J. Spinelli, Hamilton, Ohio

[73] Assignee: Benjamin Obdyke Incorporated, Warminster, Pa.

[21] Appl. No.: 423,524

[22] Filed: Oct. 13, 1989

Related U.S. Application Data

[63] Continuation of Ser. No. 125,123, Nov. 25, 1987, abandoned.

[51] Int. Cl.[5] ..... E04D 13/16

[52] U.S. Cl. ..... 52/57; 52/199; 52/303; 98/42.21

[58] Field of Search ..... 52/57, 199, 302, 303; 98/42.2, 42.01, 42.21, 42.22

[56] References Cited

U.S. PATENT DOCUMENTS

| | | | |
|---|---|---|---|
| 2,200,031 | 5/1940 | Lee | 98/42.21 |
| 2,214,183 | 9/1940 | Seymour | 52/199 X |
| 2,704,500 | 3/1955 | Bonforte | 98/42.21 |
| 3,236,170 | 2/1966 | Meyer | 52/22 X |
| 3,949,657 | 4/1976 | Sells | 98/42.21 |

FOREIGN PATENT DOCUMENTS

| | | | |
|---|---|---|---|
| 2186898 | 8/1987 | United Kingdom | 52/199 |

*Primary Examiner*—David A. Scherbel
*Assistant Examiner*—Jerrold D. Johnson
*Attorney, Agent, or Firm*—Robert C. Podwil

[57] ABSTRACT

An improved means for venting building attics has an opening along the peak of a roof, and cap shingles are spaced from the underlying roof portions by an elongated, relatively thin vent. The vent comprises a matting, or matrix of randomly convoluted polymeric filaments heat bonded to a porous, sheet material layer. The sheet material layer overlies the peak opening and is wrapped around the edges of the filament matrix, to prevent entry of foreign material into the matrix, as well as into the attic, while permitting flow of ventilating air, through the peak opening and outwardly beneath the cap shingles.

16 Claims, 2 Drawing Sheets

VENTING OF ROOFS

The present invention relates to improvements in venting roofs whereby a circulation of air may be obtained in the attic space between the roof and the underlying ceiling structure, and more particularly to improvements in the venting of the peaks of sloping roofs.

It is well recognized and, in many area, a building code requirement, that the attic area of buildings be provided with a means for the circulation of air so as to prevent undue heat buildup which would render the living quarters of the building uncomfortable and/or impose an unreasonable energy usage for cooling. To accomplish this end, in sloping roof constructions, it is necessary to provide venting means in the upper region of the attic area.

The usual practice is to employ sheet metal vents in and spaced along the length of the peak of the roof, and/or vents in the side walls of the building. The effectiveness, or efficiency, of end vents is minimal. In roofs of any substantial length, it is common practice to install one or more sheet metal vents, and not uncommon to provide a fan assist to improve air circulation. These means, involve a considerable expense, not only in the items themselves, but in the labor costs incident to their installation.

These shortcomings have been previously recognized. In U.S. Pat. No. 4,280,399, a corrugated roof vent is proposed. This vent extends lengthwise of and is secured to the portions of the roof marginally of the peak. Ridge cap shingles are then secured in place, spaced above the roof portions. Air is thus vented from the attic area through this lengthwise spacing.

Earlier, in U.S. Pat. No. 3,660,955, it was proposed to employ rows of individual spacers, glued to the roof shingles, to space the cap shingles therefrom thereby providing a ridge venting flow path, equivalent to that provided by the corrugated vent. In this patent, it is also proposed to form the spacers integrally with a strip of flexible sheet material to facilitate their separate attachment to one section, and then the other section of the roof.

These proposals to space cap shingle from the portions of the roof, marginally of the roof portions at a peak, are basically sound, but have not found widespread acceptance. It is assumed that this failure stems from both a cost factor and installation difficulties.

Another factor not fully addressed by these proposals is the intrusion of water, or water vapor, insects and other foreign matter into the attic area.

Accordingly, the object of the present invention is to provide improved means for venting the interior regions of a building.

Another object of the present invention is to provide an improved vent for spacing cap means from an angled roof portion in providing a venting flow path.

Another object of the present invention is to attain the above ends and, further, to minimize, if not prevent, the entry of water or water vapor, insects, and other foreign matter, into the building and, still further, to prevent the entry of insects into the spacing means where they could become a source of nuisance.

A further object of the present invention is to attain the foregoing ends in an economical manner requiring labor skills possessed by the average roof installer and involving a time increment for installation only slightly greater than required for the installation of cap shingles.

According to one aspect of the invention, these ends are broadly attained by a vent for installation on outer, relatively angled surfaces of a building. The vent is characterized in that it spaces a cap from said angled surfaces to provide a venting flow path for air to flow outwardly from the building. The vent comprises an elongated matrix strip which is characterized by having multiple flow paths therethrough; by being self-supporting; by having a composite strength in compression sufficient to support an overlying cap; and by a resilience sufficient to restore it to substantially its original thickness in the event it is temporarily compressed during, or after installation.

The vent matrix is, preferably, a matting of filaments, which are formed of a polymer immune to degradation in the environment of a roof installation, and, further, randomly convoluted. It is further preferred that the matrix have a minimum thickness of approximately $\frac{3}{8}$ inch and that the matting filaments be formed of nylon with a diameter of approximately 0.020 inch.

In accordance with another aspect of the invention, the foregoing ends may be broadly attained by a vent which spaces a cap from elongated slot means formed along the length of the juncture of the angled roof portion. The vent comprises an elongated openwork member providing multiple flow paths for the venting flow of air from said elongated slot means and beneath the cap, and a sheet material layer covering said openwork member. The sheet material layer is adapted to overly the elongated slot means and has a multiplicity of closely spaced, openings for the flow of venting air therethrough. These openings are relatively small thus providing a barrier to the entry of insects into the interior of the building.

Preferably, the sheet material layer is wrapped around the side edges of the openwork member and secured to the marginal edge portions of the opposite surface of the openwork member.

It is also preferable that the openwork member. employed in combination with the sheet material layer, be in the form of a matrix comprising a matting of filaments characterized by being self-supporting; by having a composite strength, in compression, sufficient to support an overlying cap; and by a resilience sufficient to restore it to substantially its original thickness in the event it is temporarily compressed during, or after installation. Additionally it is preferred that the sheet material layer is further characterized by being non-wicking to provide a barrier to entry of moisture into the interior of the building.

Further advantages are found in the use of a sheet material layer formed of non-woven fibers and the one side of the matrix is heat bonded to the sheet material layer at randomly spaced points. In accordance with more specific aspects of the invention, the matrix matting has a minimum thickness of approximately $\frac{3}{8}$ inch. The matting filaments are formed of nylon, with a diameter of approximately 0.020 inch. The sheet material is a filter material formed of polyester fibers, having an equivalent opening size of 150 microns, and the sheet material layer is detachable from the filament matting without destroying the barrier properties thereof.

Another feature of the invention is found in forming the matrix as two lengthwise segments, bonded to the sheet material. The sheet material thus serves as a hinge, facilitating the positioning of a vent on opposite sides of the peak.

Installation of the present vent involves only slightly more effort beyond that required for installation of conventional cap shingles, or cap means.

The vent materials, compositely, are flexible so that it may be coiled in rolls for convenience is storage and handling on a job site. A length is cut, from the supply of vent material, slightly greater than length of the slot means. The slot means, in turn, preferably extend to points spaced adjacent to, and are spaced from the opposite ends of the roof peak. The sheet material layer is freed from opposite ends of the severed length. Then short lengths are cut from each end of the matrix. The sheet material is then wrapped around the end edges of the matrix to provide the barrier protection for the ends of the vent. Where the matrix is formed as two lengthwise segments, positioning of the vent is facilitated by the hinging action of the sheet material.

Cap shingles may then be laid over the vent and nailed into place, in the same general fashion as is the vent were not employed.

Another feature of the present invention is found in the ability to readily join segments, so that there is little or no waste material. Thus, the sheet material layer may be freed from one end of a length of vent material, and a short length of matrix material severed therefrom. This length is then aligned with and butted against a second length. The freed sheet material layer may then be bonded to the outer surface of the second length and employed in the provision of a roof vent, as previously set forth.

The above and other related objects and features of the invention will be apparent from a reading of the following description of a preferred embodiment and the novelty thereof pointed out in the appended claims.

Figure 1:
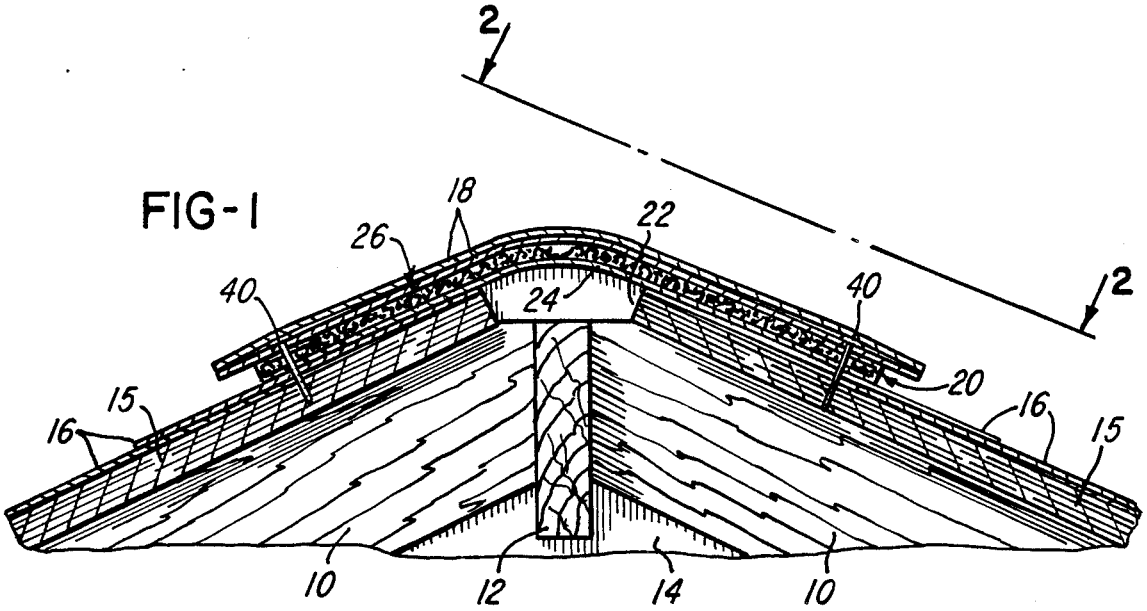
FIG. 1 is a section through the peak of a roof illustrating the installation of the vent of the present invention.
Figure 2:
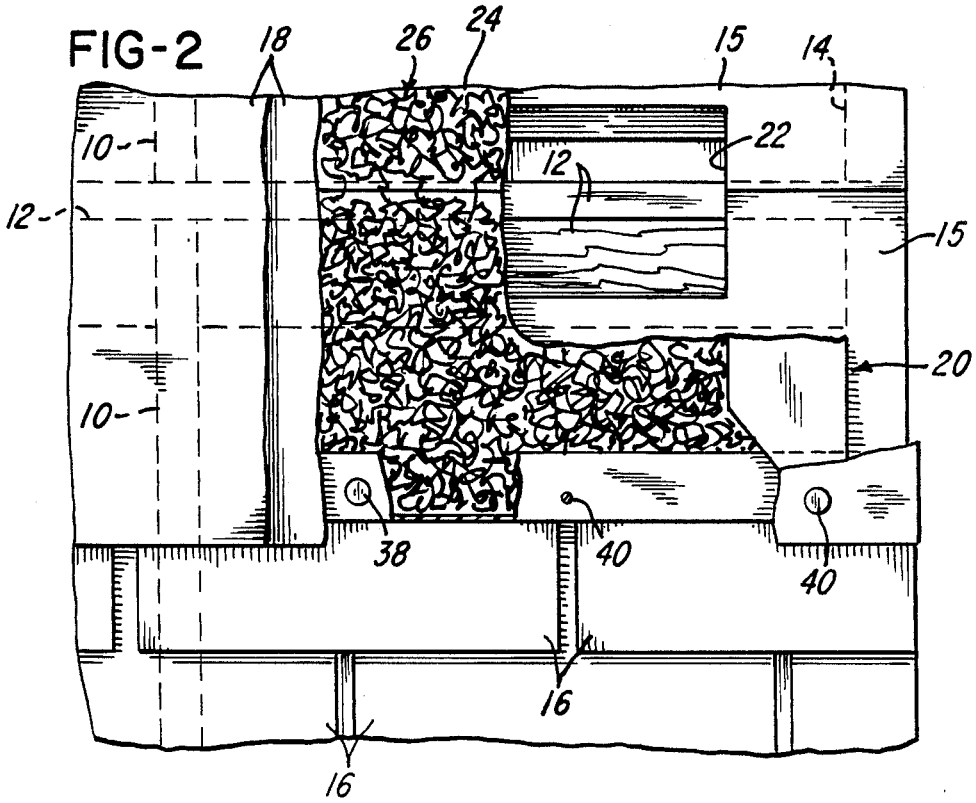
FIG. 2 is a view, taken on line 2—2 in FIG. 1 with portions broken away and in section.

FIGS. 1 and 2 illustrate a typical roof construction in which the present invention may be incorporated. The structural members of the roof may comprise a plurality of slated rafters 10, conventionally supported at their lower ends by the front and rear walls of the building. The upper ends of the rafters 10 meet at, and are attached to, a ridge pole 12, which extends between the end walls 14 of the building.

Sub-roofing 15, typically comprising plywood panels, is secured to the rafters 10 and extends to the end walls 14. Conventional shingles 16 may be nailed to the sub-roofing 14 to finish the sloping portions of the roof in accordance with accepted construction practice. Conventional cap shingles 18 may then be employed in over lapping fashion to cover the peak of the roof, above the ridge pole 12.

In accordance with the present invention, a vent 20 is interposed between the cap shingles 18 and the underlying, compositely formed portions of the roof, as will be more fully described.

A slot 22 is provided along the length of the peak of the roof to provide a passageway for venting air from the underlying attic area. The ends of the slot are spaced from the opposite ends of peak, as seen in FIG. 2. This spacing is, preferably, in the order of six inches.

Figure 3:
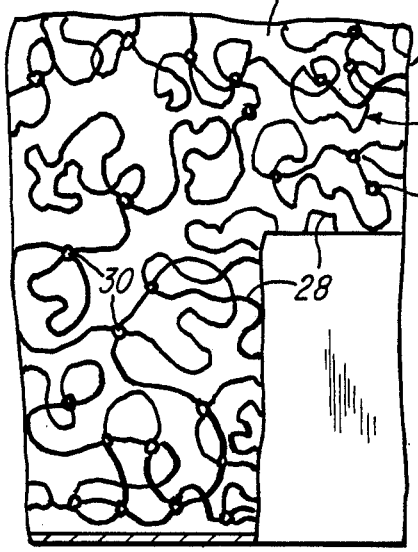
FIG. 3 is a fragmentary, plan view, on an enlarged scale, of the roof vent of the present invention.
Figure 4:
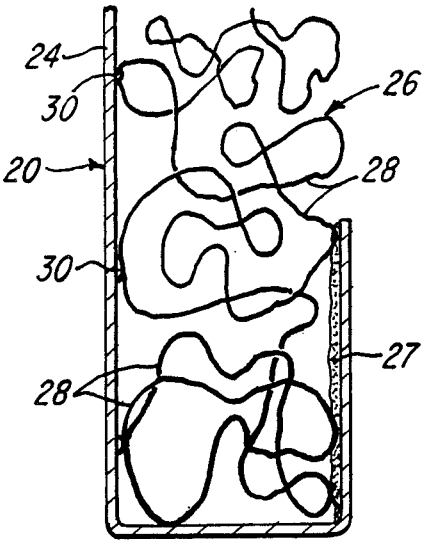
FIG. 4 is a fragmentary, end view, on an enlarged scale, of the roof vent seen in FIG. 3.

Referencing FIGS. 3 and 4, the vent 20 is shown in greater detail. It comprises a sheet material layer 24 and a matrix 26.

The sheet material 24 serves several purposes. One characteristic is that the sheet material layer is permeable, to permit the free flow of air in venting the attic area of the roof. Another function of the sheet material is to provide a barrier protecting the attic area from the entry of both insects and water and/or snow.

As will be seen from FIG. 1, the sheet material layer 24 overlies the slot 22, thus providing a primary barrier for preventing entry of insects, and other foreign matter, into the attic area. It will further be seen that the sheet material layer 24 is wrapped around the side edges of the resilient matrix 26 and then overlies the marginal, side portions of this matrix, being bonded thereto by a layer of adhesive 27. The adhesive 27 is preferably of the latex type permitting release of the sheet material without causing tears in that material. Further, the sheet material layer 24 is also wrapped around the end edges of the resilient matrix 26 and overlies the marginal end portions, FIG. 2. There is thus provided a barrier which prevents the intrusion of insects into the matrix 26, where, otherwise, they could breed and become a source of nuisance.

While the sheet material layer is permeable to air, as is necessary for its venting function, preferably, it is a barrier to liquid flow. This function is required, for example, in the event of driving rain, to prevent water from entering the attic area. The feature of wrapping the sheet material layer around the side and end edges of the resilient matrix 26 provides this water barrier function. It is further preferred that the sheet material layer 24 be non-wicking, and preferably hydrophobic. Thus, in the event of rain, water the tendency of water, or water vapor, to be drawn into the area of the slot 22, where it could enter the attic, or become the source of high humidity which would deteriorate the wooden components of the roof.

The several functions and characteristics of the layer 24 are preferably provided by a non-woven polyester fiber, filter fabric, with a thickness of approximately 0.030 inch and having an equivalent opening size of 150 microns. Further, this non-woven fabric is characterized by being constituted with a liquid, acrylic binder, which not only gives it the desired non-wicking property, but enhances this characteristic by rendering it hydrophobic. The manufacture of such non-woven fabrics is a well developed art. The functional characteristics desired are sufficient to define and enable the acquisition, from commerical sources, of the fabric employed herein.

The matrix 26 preferably comprises a matting of randomly convoluted filaments, or wires, 28 compositely providing a resilient characteristic. These ends may be advantageously supplied through the use of nylon filaments 28. This is a thermoplastic polyamide resin which may be extruded in situ and heat bonded to the underlying sheet material layer 24 at ransomly spaced points (indicated by reference character 30). The filaments 28 are thus bonded to the sheet material layer 24 in a releasable fashion, permitting the layer to be pulled free from the matrix, without causing rips or tears in the material, for purposes which later appear.

The randomly convoluted filament matrix 26 is advantageously formed and bonded to the sheet material layer 24 by extrusin of a melted polymer through articulated spinerets. The hot melt polymeric filaments bond to the sheet material layer. U.S. Pat. Nos. 3,687,759, 3,691,004 and 4,212,692 teach methods and apparatus for so forming the matrices in the manufacture of matting material employed, primarily, in ground stabilization, foundation drainage systems, artificial ski slopes and the transportation of freshly grown sod, all being unrelated to the specific problem of providing an economical means for venting attics and the like, as herein taught.

It has also been found preferable that the matrix 26 have a thickness of approximately ⅜ inch and that the diameter of the nylon filaments be approximately 0.020 inch. Further, it is preferred to incorporate 0.5% carbon black, by weight, in the "Nylon 6" material. The purpose of the carbon black is t inhibit degradation of the polymeric material through exposure to ultra-violet radiation.

The described matrix 26 provides a basic function of spacing the cap shingles 18 above the underlying, peak portion of the compositely formed roof, thus providing a venting passageway for the flow of air from the attic-venting slot 22. Further, this matrix is relatively plastic, i.e., capable of deformation without fracturing. Thus the vent 20 can be nailed, or stapled, to the sub-roofing without the need of special care. That is, while it would be preferable to drive a nail into the sub-roofing so that its head is spaced therefrom a distance approximating the vent thickness, no harm is done if a nail is driven to the point that the matrix is compressed beneath the head.

The described matrix further has a resilient feature which is of particular significance. For example, when installed, the vent 20 is not readily apparent. It must, necessarily, be anticipated that workers on the roof will step on the cap shingles, so that their weight will compress the vent the portion of the matrix 26 beneath their feet. The resilient characteristic of the matrix, after this crushing pressure has been removed, will restore the matrix, substantially, to its original height, thus maintaining the desired venting flow area.

It will also be noted that the described materials, from which the vent 20 is fabricated, meet another requirement in that they are essentially immune to degradation in an outdoor environment over a wide temperature and humidity ranges.

Figure 8:
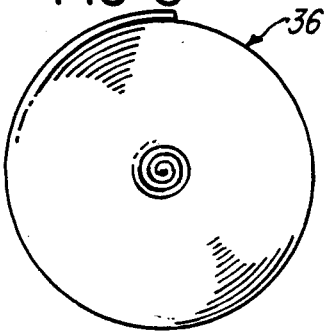
FIG. 8 illustrates, on a reduced scale, the roof vent of the present invention, in roll form, for shipping, or storage.

Vent material may be fabricated in indeterminate lengths. The matrix may be formed on and attached to the sheet material layer 24. The sheet material layer is then wrapped around the side edges of the matrix 26 and folded against the upper, marginal surfaces of the matrix and secured thereto by the adhesive layer 27, FIG. 4. The compositely formed vent material is relatively flexible and may be readily coiled in rolls, as is illustrated by the roll 36 seen in FIG. 8. Rolls having a length of 120 feet, or more, have been found practical. The coilable feature facilitates storage and transportation of the vent material.

Installation of the vent 20 involves a labor cost which is just slightly greater than that required for the normal installation of cap shingles. It represents a very substantial saving over the installation of conventional sheet metal roof vents of the type which provide a localized venting flow a points spaced along the length of the peak of the roof.

As a first step, a section of venting material may be cut from a roll, with a length approximating, or somewhat greater than, the length of the roof peak to which it is to be applied. It is to be noted the the matrix filaments and the sheet material layer are easily severed, even by ordinary, heavy duty scissors, a feature which also facilitates use of the present invention.

Next, the sheet material layer 24 is freed from the end portions of the matrix 26. Then a segment, approximately two inches in length is severed from each end of the matrix material. The sheet material layer is then wrapped around the end edges of the matrix and folded against the marginal, upper end portions of the matrix, as seen in FIG. 2. The releasable attachment of the sheet material layer to the matrix facilitates this provision of a barrier at the end edges of the vent 20.

Figure 5:
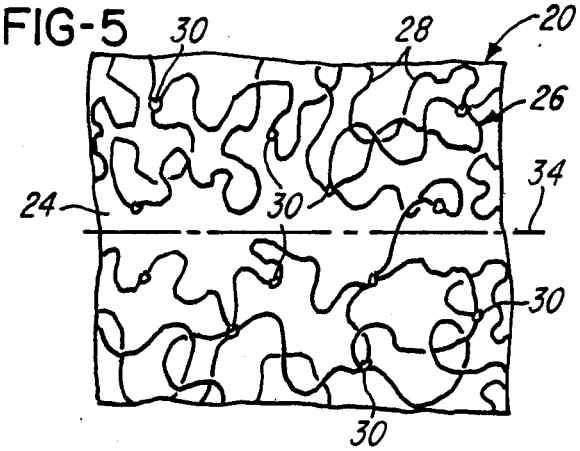
FIG. 5 is a plan view of a hinged portion of the vent.
Figure 6:
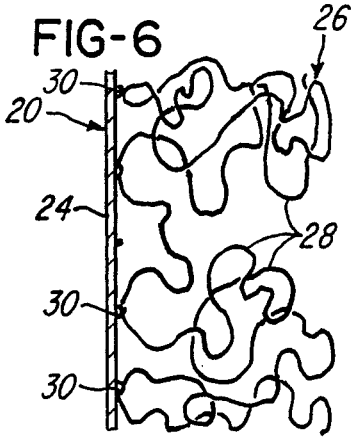
FIG. 6 is a section through the hinged portion of FIG. 5.

From FIGS. 5 and 6, it will be seen that the bonding points 30, attaching the filaments 28 to the sheet material layer 24, are spaced on opposite sides of a longitudinal, central hinge line 34. Further the matrix filaments are concentrated on opposite sides of this line. Thus, the matrix matting is formed as two lengthwise segments, of equal width, on opposite sides of the hinge line 34.

While the structural strength, in flexure, of the compositely formed vent is relatively low, there is sufficient stiffness to enable them to readily flex relative to each other about the hinge line 34 (defined by the absence of bonding points 28 and relative absence of filaments 30). The vent will therefore, readily lay flat against the angled portions of the roof on opposite sides of the peak.

After the vent 20 is thus positioned, it may be positively held in place by a few nails 38, to prevent accidental displacement. Finally, the cap shingles 18 are installed, by nails 40, in conventional, overlapping fashion.

Figure 7:
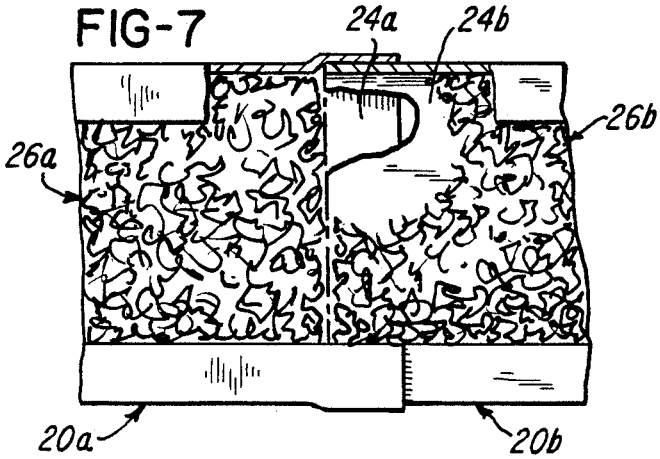
FIG. 7 is a plan view illustrating the method of joining two sections of vent material.

One final feature to note is the ability to splice sections of vent material, enabling the use of sections which are too short for the length of a roof peak on which an installation is to be made. The process is similar to the provision of a sheet material barrier for the end edges of the matrix and is illustrated in FIG. 7. The sheet material layer **24*a* is freed from one end of matrix 26*a* of one section 20*a* of vent material and a short length of the matrix 26*a* removed by cutting it. A second section 20*b* of vent material is then butted against this severed end of the matrix with the two sections being aligned. Adhesive may be applied to the layer 24*a* which has been exposed by cutting the matrix, thereby providing a means for securing it to the layer 24*b* of the overlying portion of the second section. The freed end of the layer 24*a*** may be wrapped around the side edges of the second section and overly the upper surface of that section.

The described vent may also be installed where corrugated, tile shingles are employed as a roofing material.

It should also be appreciated that venting of building roofs may be required other than at the peak of two sloping roof portions. Thus the present vent may be installed to space, for example, a cap type shingle, or flashing from an angled roof portion which joins a vertical building wall.

Variations from the preferred teachings disclosed herein will be apparent to those skilled in the art, within the scope and spirit of the present inventive concepts which are defined in the following claims.

Having thus described the invention, what is claimed as novel and desired to be secured by Letters Patent of the United States is:

1. A vent installation on outer, relatively angled surfaces of a building, characterized in that the vent spaces a cap from said angled surfaces to provide a venting flow path for air to flow outwardly from the building through an elongated slot means formed at the juncture between the angled surfaces, said vent comprising an elongated openwork member providing multiple flowpaths for the venting flow of air from said elongated slot and beneath the cap, said openwork member comprising a resilient self-supporting matrix strip, and a sheet material layer secured to and covering said openwork member and adapted to overly said elongated slot, said sheet material layer being an air-permeable filter material having a multiplicity of closely spaced openings for the free flow of venting air therethrough, said openings being relatively small to provide a barrier to the entry of insects into the interior of the building, through said elongated slot.

2. A vent as in claim 1 and said openings in said sheet material layer having an equivalent opening size of about 150 microns.

3. A method of installing a vent for the peak of a roof formed by relatively angled roof portions, said roof portions having elongated slot means extending along the length of the peak comprising the steps of cutting a vent, from a supply of vent material, to a length at least as great as the length of the slot means, said vent comprising an elongated matrix strip, said matrix being characterized by having multiple flowpaths there through; and a layer of sheet material adhered to one side of said matrix strip and overlying said slot means, said vent material having a sheet material layer covering one surface of said matrix, said sheet material layer having a multiplicity of closely spaced openings for the flow of venting air there through, said openings being relatively small to provide a barrier to the entry of insects into the attic area of the building, through said slot means, positioning said vent longitudinally and approximately centrally of said peak, with the sheet material layer thereof directly overlying said slot means, securing cap means which extend marginally of the upper surfaces of the roof portions, in overlying relation to said slot means by fasteners which extend through the cap means the vent and into the underlying roof portions, said matrix being further characterized by being self-supporting; by having a composite strength in compression sufficient to support an overlying cap; and by a resilience sufficient to restore it to substantially its original thickness in the event it is compressed during, or after installation, the sheet material layer being wrapped around the side edges of the matrix and releasably bonded to the opposite, marginal portions of the upper surface of the matrix, and the further steps of releasing the sheet material layer from the end portions of the vent which has been cut from the supply of vent material, severing relatively short segments from each end of matrix, and wrapping the sheet material layer around the end edges of the matrix and against the top surface thereof, whereby a barrier is provided against entry of insects into the interstices of the matrix.

4. A method as in claim 3 wherein the vent material comprises two lengthwise matrix segments of approximately equal width and the sheet material functions as a hinge, and the step of positioning the vent includes the step of generally aligning the vent hinge with the roof peak, whereby the the positioning step is facilitated.

5. A method as in claim 3, wherein it is desired to utilized a length of vent material, the length of which is shorter than the length of the slot means, further including the step of joining two lengths of vent material to form a supply of vent material of sufficient length, including releasing the sheet material layer one end portion of one of said lengths, severing a segment of matrix from the end from which the sheet material has been released, butting the end of said second length, against the severed end of the matrix of said first length, with the two lengths aligned, and wrapping the sheet material layer of the first length against the adjacent outer surfaces of the sheet material layer of said second length and bonding it thereto.

6. A vent installation on outer, relatively angled surfaces of a building, characterized in that the vent spaces a cap from said angled surfaces to provide a venting flow path for air to flow outwardly from the building through an elongated slot means formed at the juncture between the angled surfaces, said vent comprising an elongated openwork member providing multiple flowpaths for the venting flow of air from said elongated slot and beneath the cap, a sheet material layer covering said openwork member and adapted to overly said elongated slot, said sheet material layer having a multiplicity of closely spaced openings for the flow of venting air there through, said openings being relatively small to provide a barrier to the entry of insects into the interior of the building, through said elongated slots, and said sheet material layer being wrapped around the side edges of said openwork member and secured to the marginal edge portions of the opposite surfaces of said openwork member.

7. A vent in claim 6 wherein said openwork member is a matrix comprising a matting of filaments characterized by being self-supporting; by having a composite strength, in compression, sufficient to support an overlying cap; and by a resilience sufficient to restore it to substantially its original thickness in the event it is compressed during, or after installation.

the sheet material layer is further characterized by being non-wicking to provide a barrier to entry of moisture into the interior of said building.

8. A vent as in claim 7 wherein the matrix matting comprises randomly convoluted, polymeric filaments.

the sheet material layer is formed of non-woven fibers and said one side of the matrix is heat bonded to the sheet material layer at randomly spaced points.

9. A vent as in claim 8 wherein matrix matting has a minimum thickness of approximately ⅜ inch, and the matting filaments are formed of nylon, with a diameter of approximately 0.020 inch, and the sheet material is a filter material formed of polyester fibers, having an equivalent opening size of 150 microns, and the sheet material layer is detachable from the filament matting without destroying the barrier properties thereof.

10. A vent as in claim 6 wherein the openwork member comprises two lengthwise segments and the sheet material layer provides a hinge permitting the segments to be readily positioned on the relatively angled portions of the building.

11. A vent as in claim 10 wherein the openwork member comprises a matrix matting of randomly convoluted filaments and the sheet material is a hydrophobic filter material comprising non-woven fibers.

12. A roof vent system comprising two roof portions, angled to a longitudinal peak, slot means extending along the length of said peak for venting air from the attic area beneath the roof portions, a cap overlying the upper, marginal edge portions of said roof portions, and a vent spacing said cap means above said roof portions said slot, said vent comprising an elongated matrix strip, said matrix strip being characterized by having multiple flowpaths there through; by being self-supporting; by having a composite strength in compression sufficient to support an overlying cap; and by a resilience sufficient to restore it to substantially its original thickness in the event it is compressed during, or after installation, and said layer of sheet material adhered to one side of said matrix strip and overlying said slot means, a sheet material layer covering said matrix and adaption to overly said slot when said vent is operatively disposed, said sheet material layer having a multiplicity of closely spaced openings for the flow of vent air there through, said openings being relatively small to provide a barrier to the entry of insects into the attic area of the building, through said slot, said sheet material layer being wrapped around the side and end edges of said matrix and overlying the upper, marginal portions of the upper surface of said matrix.

13. A vent as in claim 12 wherein said matrix comprising a matting of filaments characterized by being self-supporting; by having a composite strength, in compression, sufficient to support the overlying cap means; and by a resilience sufficient to restore it to substantially its original thickness in the event it is compressed during, or after installation.

the sheet material layer is further characterized by being non-wicking to provide a barrier to entry of moisture into the interior of said building.

14. A vent as in claim 13 wherein the cap means comprise a plurality of overlapping shingles, the roof portions each comprise a wooden sub-roofing member to which shingles are secured by fasteners extending through the shingles and into the sub-roofing, the openwork member comprises a matrix matting of randomly convoluted filaments, the sheet material is a hydrophobic filter material comprising non-woven fibers, and the cap shingles are secured by fasteners extending therethrough, through the vent and extending into the sub-roofing.

15. A roof vent system comprising two roof portions, angled to a longitudinal peak, slot means extending along the length of said peak for venting air from the attic area beneath the roof portions, cap means overlying the upper marginal edge portions of said roof portions, and a vent spacing said cap means about said roof portions and said slot means, said vent comprising an elongated matrix strip, said matrix strip being characterized by having multiple flowpaths there through; by being self-supporting; by having a composite strength in compression sufficient to support an overlying cap; and by a resilience sufficient to restore it to substantially its original thickness in the event it is compressed during, or after installation, and a layer of sheet material adhered to one side of said matrix strip and overlying said slot means, said sheet material layer covering said matrix and adapted to overly said slot when said vent is operatively disposed, said sheet material layer being a non-wicking hydrophobic filter material having a multiplicity of closely spaced openings for the flow of venting air there through, said openings being relatively small to provide a barrier to the entry of insects into the attic area of the building through said slot means.

16. A vent as in claim 15, and said openings in said sheet material layers having an equivalent opening size of about 150 microns.

* * * * *